US005326286A

United States Patent [19]

Bixler et al.

[11] Patent Number: 5,326,286

[45] Date of Patent: Jul. 5, 1994

[54] ELECTRICAL CONNECTOR ASSEMBLY WITH TERMINAL ALIGNMENT SYSTEM

[75] Inventors: Craig Bixler, Elmhurst; Richard A. Nelson, Glen Ellyn, both of Ill.

[73] Assignee: Molex Incorporated, Lisle, Ill.

[21] Appl. No.: 991,927

[22] Filed: Dec. 17, 1992

[51] Int. Cl.[5] ..... H01R 13/42

[52] U.S. Cl. ..... 439/751; 439/873; 439/405

[58] Field of Search ..... 439/395–407, 439/733, 744–747, 751, 873

[56] References Cited

U.S. PATENT DOCUMENTS

| | | | |
|---|---|---|---|
| 3,444,506 | 5/1969 | Wedekind | 339/99 |
| 4,441,779 | 4/1984 | Foederer et al. | 339/99 R |
| 4,512,620 | 4/1985 | Tillotson | 339/97 P |
| 4,564,254 | 1/1986 | van Alst | 439/404 |
| 4,641,903 | 2/1987 | Anhalt et al. | 339/99 R |
| 4,648,677 | 3/1987 | Lang | 439/404 |
| 4,808,122 | 2/1989 | Tomizu et al. | 439/404 |
| 4,902,243 | 2/1990 | Davis | 439/405 |
| 4,946,390 | 8/1990 | Smyers | 439/404 |
| 4,950,177 | 8/1990 | Szczesny | 439/404 |
| 5,147,218 | 9/1992 | Mathews | 439/404 |

*Primary Examiner*—David L. Pirlot

*Attorney, Agent, or Firm*—Charles S. Cohen

[57] ABSTRACT

A terminal alignment system is provided for an electrical connector assembly disclosed as an insulation displacement type connector for terminating a plurality of insulated conductors of a multi-conductor cable. The connector includes a dielectric housing having a plurality of terminal-receiving passageways for the insertion thereinto of a plurality of terminals in a given insertion direction. Each terminal includes an insulation displacement section at one end for piercing the insulation about one of the conductors, a contact section at an opposite end for mating with a mating terminal, and an intermediate securing section between the ends for securing the terminal in a respective one of the passageways. The insulation displacement section of each terminal includes a notch facing in the insertion direction. The housing includes a rib for interengagement with each notch. Therefore, upon insertion of the terminals into the passageways, the notch of each terminal engages a respective rib to accurately align the insulation displacement section of the terminal prior to termination thereof to one of the insulated conductors. The terminal notches and the housing ribs are located within the bounds of the insulation displacement sections.

8 Claims, 3 Drawing Sheets

ELECTRICAL CONNECTOR ASSEMBLY WITH TERMINAL ALIGNMENT SYSTEM

FIELD OF THE INVENTION

This invention generally relates to the art of electrical connectors such as insulation displacement type connectors and, particularly, to a system for maintaining proper alignment of the terminals of the connector prior to termination.

BACKGROUND OF THE INVENTION

Electrical connectors are used in a wide variety of applications to make various electrical connections between different circuits or electrical components. Most connectors include a housing made of insulating material such as plastic or the like, and the housing mounts a plurality of terminals. The terminals are arranged in a particular pattern, and conductors from different circuits are connected to respective different ones of the terminals. The pattern of terminals in the housing correspond, for example, to a plurality of mating terminals of a second or complementary connector or electrical component. In some connectors, the conductors are separately terminated to the individual terminals, and in other connectors the conductors are terminated through mass termination methods.

One type of electrical connector is an insulation displacement type connector for terminating a plurality of insulated conductors of a multi-conductor cable. Such a connector includes a plurality of terminals having insulation-displacement sections at one end for piercing through the insulation of the conductors to establish electrical connection or conductivity with respective conductive cores of the conductors.

One type of insulation displacement electrical connectors involves termination of high density ribbon cables which are generally flat, with a plurality of conductors in a plane surrounded by insulating material and also joined by insulating web portions of the flat ribbon cable. The insulation displacement sections of the terminals cut through the insulating mass of the ribbon cables to establish conductivity with the planar array of conductors. Such ribbon connectors have been designed for mass terminating extremely high density ribbon cables, with the conductors of the cables spaced as close as on the order of 0.025 inch.

One of the problems with high density electrical connectors, such as connectors for mass terminating ribbon cables, is to maintain the terminals, particularly the insulation displacement sections of the terminals, in proper alignment prior to termination. The terminals most often are stamped and formed from thin sheet metal material and can be bent or deformed during fabrication, handling or assembly processes. During the termination processes, even one misaligned terminal can cause the entire electrical connector assembly to become damaged or defective.

Heretofore, a variety of approaches have been made to ensure proper alignment of the tiny terminals in electrical connectors, particularly high density electrical connectors, including ribbon cable connectors as described above. Many alignment approaches involve the use of side walls, abutting shoulders, ramped surfaces and the like, molded integrally with the connector housing, usually about the terminal-receiving passages in the housing, to bias the terminals into proper aligned positions as the terminals are assembled or inserted into the housing passages. These approaches have proven effective in a variety of applications, but new alignment concepts have become necessary in extremely high density connectors, such as in terminating conductors which have a pitch or center-line spacing as small as 0.025 inch. Using such alignment means as passage side walls, abutting shoulders, ramped surfaces and the like of the prior art, are either inappropriate or make the manufacture of the connector extremely complicated when used with such closely spaced conductors and their respective terminals. Such means usually are provided in the housing outside the bounds or peripheral dimensions of the terminals. When the terminals are spaced extremely close to each other to accommodate the high density conductors, there simply is insufficient wall space between the terminal passageways to economically provide such alignment means.

This invention is directed to solving these problems by providing an extremely simple but effective system for aligning terminals in a high density electrical connector.

SUMMARY OF THE INVENTION

An object, therefore, of the invention is to provide a new and improved terminal alignment system for aligning terminals in an electrical connector housing.

In the exemplary embodiment of the invention, although not limited to any particular type of application, the alignment system of the invention is incorporated in an insulation displacement type electrical connector for terminating a plurality of insulated conductors of a multi-conductor cable. As disclosed herein, the cable is a high density ribbon cable. The connector includes a dielectric housing having a plurality of terminal-receiving passageways for the insertion thereinto of a plurality of terminals in a given insertion direction. Each terminal includes an insulation displacement section at one end for piercing the insulation about one of the conductors, a contact section at an opposite end for mating with a mating terminal, and an intermediate securing section between the ends for securing the terminal in a respective one of the passageways in the housing.

Generally, the invention contemplates that each terminal include an alignment portion or section of a given width. Complementary interengaging alignment means are provided between the alignment portion and the housing and located within the bounds of the given width of the alignment portion. Therefore, the alignment system is not dependent upon or effected by any wall means or other structure of the housing between any two pair of terminals.

Specifically, in the preferred embodiment of the invention, the insulation displacement section of each terminal includes the alignment portion and has a notch facing in the insertion direction of the terminal. The housing includes a rib for interengagement within each notch. Therefore, upon insertion of the terminals into their passageways, the notch of each terminal engages a respective rib to accurately align the insulation displacement section of the terminal prior to termination thereof to one of the insulated conductors.

Still further, the terminals are fabricated of stamped and formed sheet metal material and the insulation displacement sections or alignment portions of the terminals are generally planar with respective side edges. The notches in the terminals and the ribs of the housing are located to be confined within or between the side edges of the alignment portion of the insulation displacement section.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
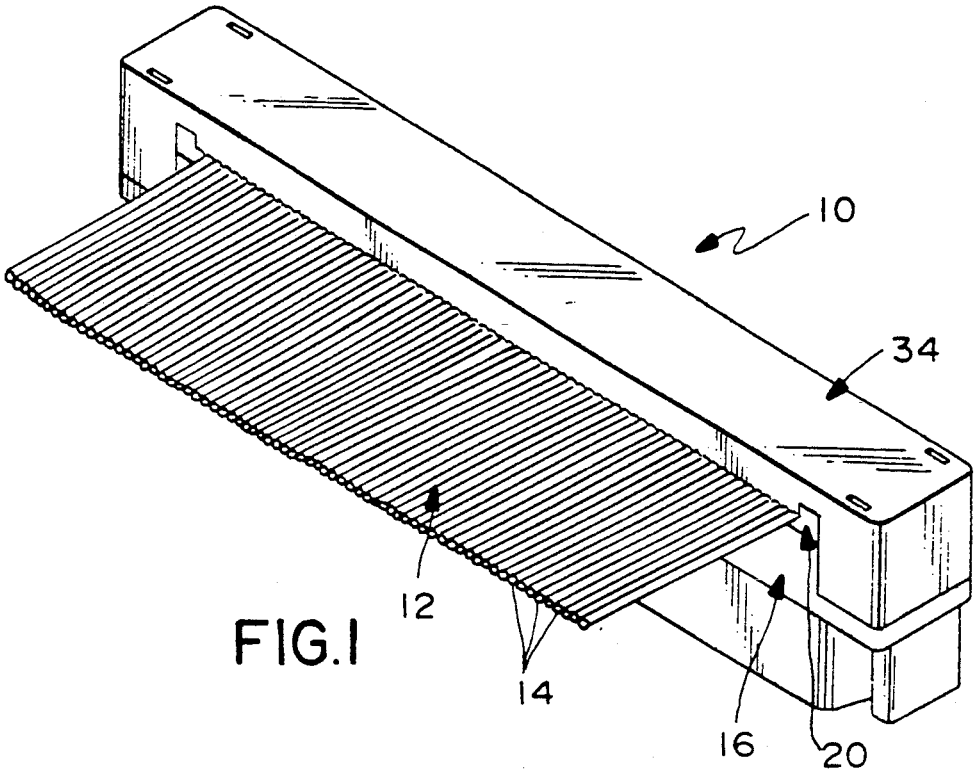
FIG. 1 is a perspective view of an electrical connector according to the invention, shown in fully terminated position terminated to a ribbon cable.
Figure 2:
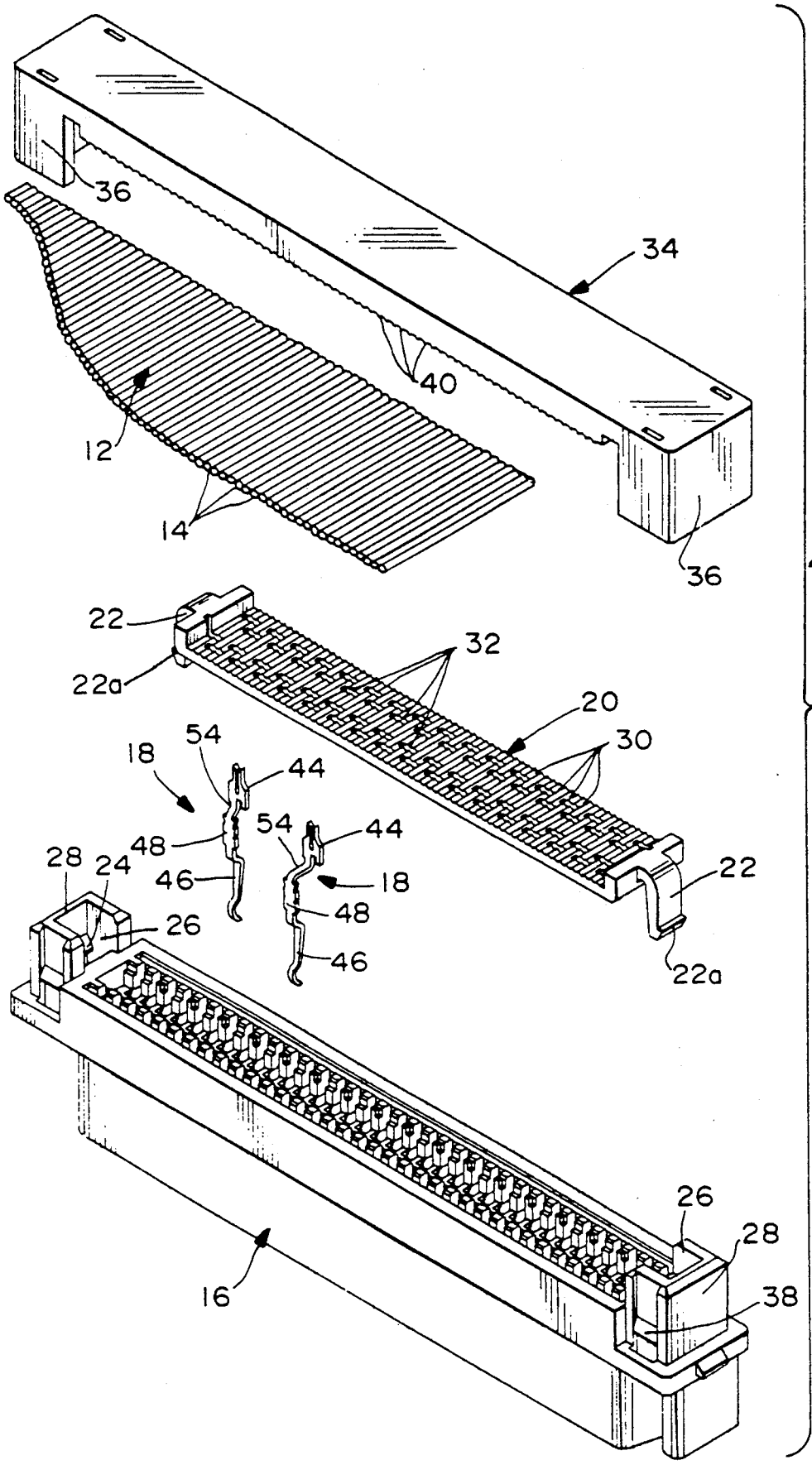
FIG. 2 is an exploded perspective view of the electrical connector, along with the ribbon cable.

Referring to the drawings in greater detail, and first to FIGS. 1 and 2, the invention is incorporated in an insulation displacement type electrical connector, generally designated 10 (FIG. 1), for terminating a plurality of insulated conductors of a multi-conductor ribbon cable, generally designated 12. The ribbon cable has a very high density and includes a plurality of conductors 14 on center-line spacing as small as 0.025 inch. As is known in the art, such ribbon cables include insulating material surrounding each conductor as well as a web of insulating material joining the conductors in a planar array, as shown.

As best seen in FIG. 2, electrical connector 10 includes a dielectric housing, generally designated 16, unitarily molded of plastic material or the like for receiving a plurality of insulation displacement type terminals, generally designated 18. After the terminals are inserted into the housing, a cable aligning member, generally designated 20, is positioned onto the top of the housing. The cable aligning member is unitarily molded of dielectric material such as plastic or the like and includes a pair of flexible latch arms 22 at opposite ends thereof. The latch arms have outwardly directed hook portions 22*a* for snapping behind ramped latch bosses 24 located within openings 26 of upstanding end portions 28 of housing 16. The cable aligning member has a plurality of transversely oriented troughs 30 into which individual ones of conductors 14 of ribbon cable 12 are positioned to assist in properly aligning and retaining the ribbon cable. Cable aligning member 20 also includes a plurality of longitudinally oriented apertures or slots 32 through which insulation displacement sections (described hereinafter) of terminals 18 project for piercing through the insulation of ribbon cable 12 and individually terminating the conductors of the cable.

Lastly, electrical connector 10 includes a termination cover, generally designated 34, which has channel-shaped end portions 36 for positioning over upstanding end portions 28 of housing 16 in the assembled condition of the connector as shown in FIG. 1. Appropriate latch bosses are provided within the channel-shaped end portions 36 of the termination cover for latching behind latch bosses 38 at the ends of housing 16 to hold the entire connector assembly in its terminated condition, with termination cover 34 sandwiching ribbon cable 12 between the cover and cable aligning member 20. To that end, the underside of termination cover 34 is provided with a plurality of transversely oriented troughs 40 which engage individual ones of conductors 14 of the ribbon cable in its terminated condition as shown in FIG. 1. Troughs 40 of termination cover 34 are aligned with troughs 30 of cable aligning member 20 in the assembled or terminated condition of the connector.

Before proceeding to a description of terminals 18, reference still is made to FIG. 2, and particularly to the array of apertures 32 in cable aligning member 20. It can be seen that the apertures are arranged in a pattern or array provided by two pairs of rows of apertures, with the apertures in each row in each pair of rows being longitudinally offset relative to the apertures in the other row in each pair thereof. This offsetting pattern of apertures is provided to accommodate the high density, close spacing between conductors 14 of ribbon cable 12. The pattern of apertures 34, therefore, best represents the pattern of terminal-receiving passages (described hereinafter) in housing 16 and the corresponding pattern of terminal locations within the housing.

Figure 4:
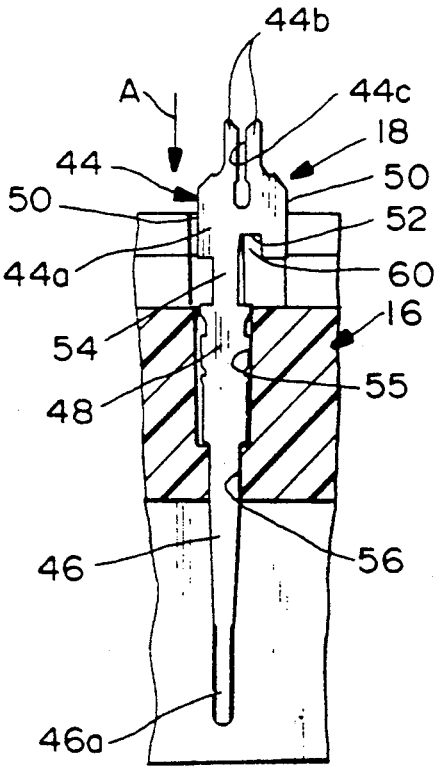
FIG. 4 is a vertical section through a portion of the housing and one of the passageways therein receiving one of the terminals of the connector.
Figure 3:
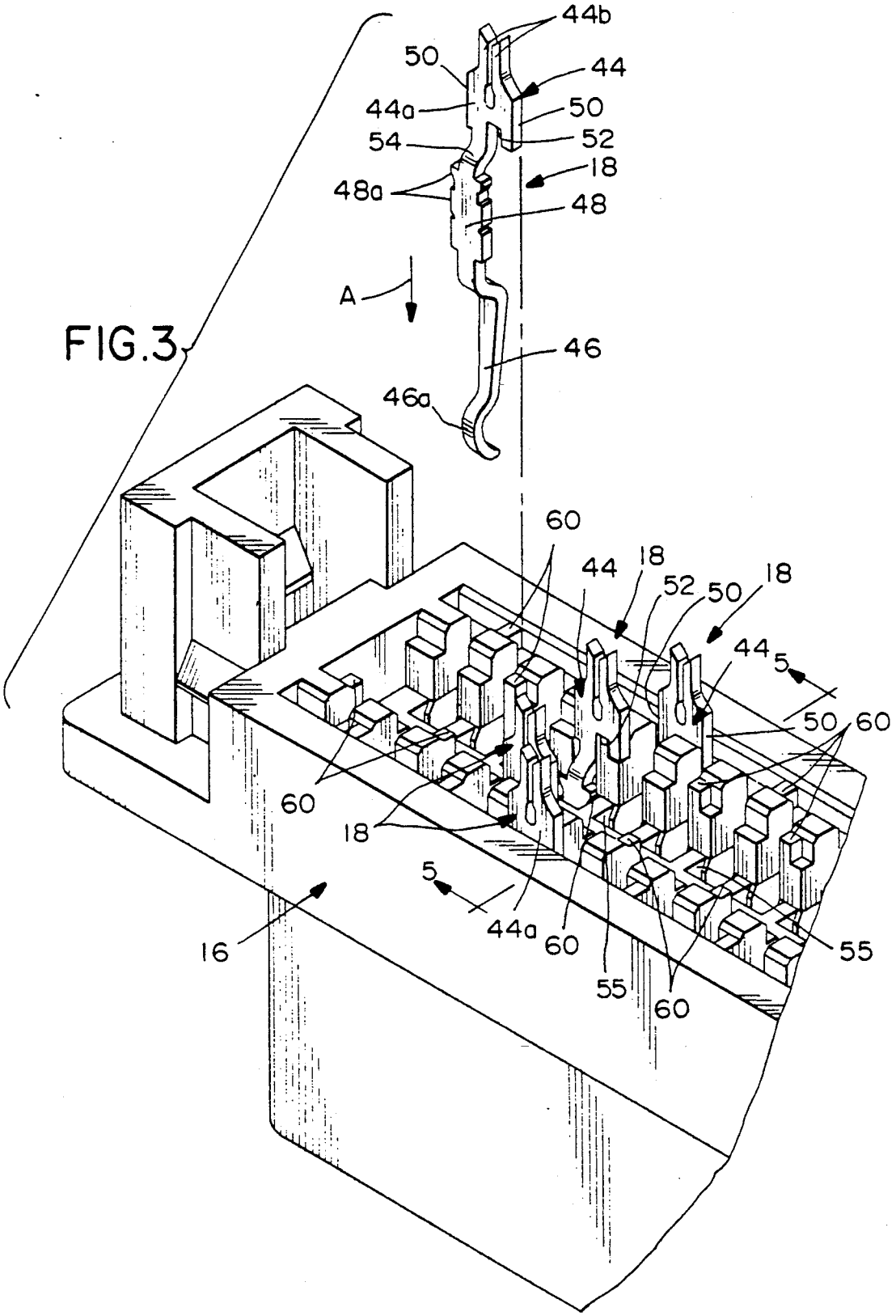
FIG. 3 is an enlarged perspective view of one end of the connector housing in conjunction with several of the insulation displacement terminals.

Referring to FIGS. 3 and 4, each terminal 18 includes an insulation displacement section, generally designated 44, at one end of the terminal, a contact section 46 at the opposite end of the terminal for mating with a mating terminal of a complementary connector (not shown), and an intermediate securing section 48 between the ends of the terminal for securing the terminal in a respective one of the housing passageways, as described hereinafter. Contact section 46 is in the form of a blade portion of the terminal, including a curved contact area 46*a* for engaging the mating terminal of the complementary connector or for engaging a contact pad of a printed circuit board. Securing section 48 includes a plurality of teeth 48*a* for securing the connector against side walls of a respective passageway in the housing in an interference fit. Insulation displacement section 44 includes an alignment portion 44*a* and a pair of spaced insulation displacement arms 44*b*. It can be seen that the arms are pointed at their distal ends so that they can be driven through the web of insulating material joining adjacent conductors 14 of ribbon cable 12, whereupon the conductors are terminated between the arms of the terminals as the arms pierce through the insulation and establish conductivity with the conductors of the ribbon cable. In addition, as best seen in FIG. 4, the insulation displacement slot 44*c* defined by arms 44*b* is laterally offset in the plane of insulation displacement section 44 to the side of the longitudinal axis of the terminal by an amount equal to one half the pitch of the ribbon cable (i.e., 0.0125 inch).

At this point, it should be noted that alignment portion 44*a* of insulation displacement section 44 of each terminal 18 includes a pair of side edges 50 which, in essence, define the bounds of the alignment portion. An alignment notch 52 is formed in alignment portion 44*a*, between side edges 50 thereof, and facing in the insertion direction of the terminal as indicated by arrow "A" (FIG. 3). Lastly, each terminal includes a transition section 54 between its insulation displacement section 44 and its securing section 48 for offsetting the insulation displacement section from the securing section in a direction transversely of the insertion direction represented by arrow "A". More specifically, each terminal 18 is stamped and formed from sheet metal material. Therefore, it can be seen in FIG. 3 how transition section 54 is formed or bent to offset insulation displacement section 44 laterally of securing section 48.

Turning to FIG. 2, the terminal 18' shown in that depiction furthest to the left is part of one of the "inner" rows of terminals and corresponds to the configuration of the terminal removed from housing 16 in FIG. 3. However, note that the transition section 54 of the terminal 18'' positioned to the right of terminal 18' in FIG. 2 is longer than the transition section of the left-hand terminal. Such terminal 18'' is part of one of the "outer" rows of terminals. The longer transition section results in offsetting the insulation displacement section 44 of terminal 18'' a greater distance from securing section 48 than the insulation displacement section of terminal 18' in order to locate the insulation displacement sections of the entire array of terminals within housing 16 in pairs of rows as best represented by the pattern of apertures 32 in cable aligning member 20, as described above. The contact sections 46, however, of the terminals of each pair of rows are aligned generally parallel to the longitudinal axis of the connector. Thus, the connector 10 has two parallel rows of contact sections 46 and four parallel rows of insulation displacement sections 44. The contact sections 46 of each terminal from one of the outer rows is aligned laterally relative to the connector with the contact section of one terminal of the other outer row. Likewise, the contact section 46 of each terminal from one of the inner rows is aligned laterally relative to the connector with the contact section of one terminal of the other inner row. Each of these aligned terminals are identical but rotated 180° so that the insulation displacement slot **44*c* of the terminals are offset in opposite directions. As a result, the insulation displacement slots 44*c* of aligned terminals are spaced a full pitch (i.e., 0.025 inch) apart. The insulation displacement slots 44*c*** of adjacent inner and outer row terminals are offset in the same direction. Since the terminals are twice the pitch of the cable apart (i.e., 0.050 inch), the insulation displacement slots of these adjacent terminals are also spaced 0.050 inch apart.

Referring to FIG. 4, terminals 18 are inserted in the direction of arrow "A" into respective terminal receiving passageways in housing 16, each passageway including a passage portion 55 communicating with a reduced-dimensioned passage portion 56. Securing section 48 of terminal 18 (shown in FIG. 4) is press-fit into passage portion 55 to secure the terminal in the housing, while contact portion 46 of the terminal extends through passage portion 56 so that the distal end of the contact portion is exposed for engagement with a mating terminal of a complementary connector or a contact pad of a printed circuit board. It should be noted in FIG. 4, as well as in FIG. 3, that insulation displacement section 44 of each terminal, particularly its alignment portion **44*a*, is not bounded on its sides by portions of the housing. Because of the high density of the terminals within housing 16 of connector 10, in order to terminate the high density closely spaced conductors 14 of ribbon cable 12**, it would very difficult to mold a myriad of partitions in the housing in order to bound and confine and, thereby, align the insulation displacement sections of the terminals. Therefore, the invention contemplates a unique system for aligning in a direction parallel to the longitudinal axis of the connector the insulation displacement sections within the bounds of the terminal itself.

More particularly, the invention generally contemplates the provision of complementary interengaging alignment means between the alignment portion of the terminals and the housing and located within the bounds of the width of the alignment portion as defined by its sides 50. This complementary interengaging alignment means is provided by notches 52 on the undersides of the alignment portions **44*a* of the terminals, the notches facing in the insertion direction ("A") of the terminal and engageable with ribs 60 of the housing. In FIG. 4, as well as with one of the center-most terminals shown in FIG. 3, it can be seen how ribs 60 seat within notches 52 and thereby prevent any lateral movement of the insulation displacement sections 44 of the terminals. This interengagement between ribs 60 of the housing and notches 52 in the terminals ensures proper alignment of the terminals, and particularly the insulation displacement arms 44*b* of the terminals for termination to the conductors 14 of ribbon cable 12. In other words, the ribs and notches establish a precise pitch for the terminals corresponding to the center-line spacing of the conductors of the cable. This is especially important when used with a stamped and formed terminal having a transition section 54 displacing the insulation displacement section 44 from the plane of securing section 48**. That is, while forming the terminal or during subsequent processing thereof, the insulation displacement section could become displaced from its desired position. The ribs and notches of the present invention reduce the likelihood of termination difficulties due to such displacement.

In assembly, each terminal 18 is inserted into housing 16 in the direction of arrow "A" as viewed in FIG. 4. As securing section 48 of each terminal is press fit into passage portion 55 of the housing, notch 52 of the terminal seats snugly over its respective rib 60 of the housing to precisely locate in a direction perpendicular to the axes of the conductors of the cable the insulation displacement portion of the terminal and maintain proper alignment of the terminal for termination to a respective one of conductors 14 of ribbon cable 12. With insulation displacement sections 44 laterally offset relative to securing sections 48 by transition section 54, passage portions 55 likewise are offset relative to ribs 60 as best seen in FIG. 3. However, it should be understood that this precise configuration is not intended to be limiting. For instance, if a terminal 18 were to be totally coplanar, without a transition section 54, rib 60 and notch 52 (as viewed in FIG. 4) simply would be moved slightly toward the right as viewed in that depiction, so that, as securing section 48 is inserted into its passageway, the securing section will pass by the alignment rib.

Figure 5:
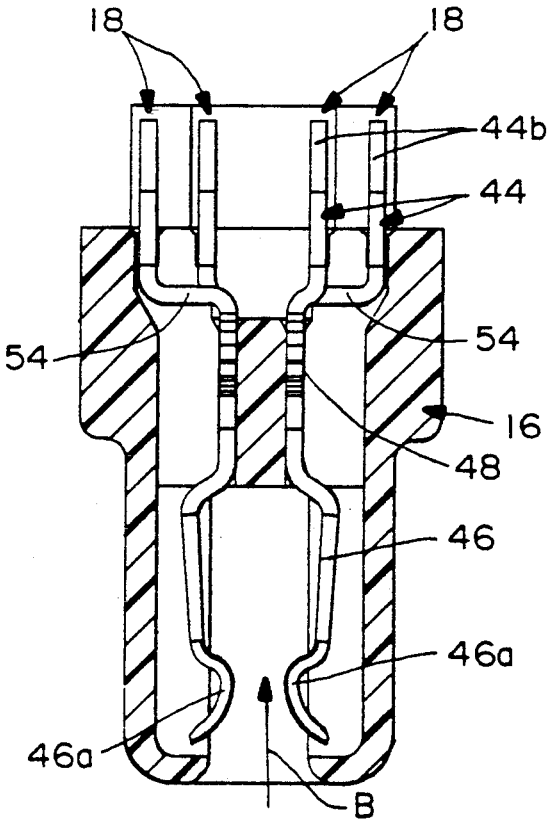
FIG. 5 is a vertical section taken generally along line 5—5 of FIG. 3 but with terminals inserted therein.

Finally, FIG. 5 shows a cross sectional depiction through housing 16 to illustrate the two pairs of rows of terminals 18 corresponding to apertures 32 in cable aligning member 20 as described above in relation to FIG. 2. The different lengths of transition sections 54 is clearly understood from the depiction of FIG. 5. This view also shows how curved contact areas **46*a* of contact sections 46 are spaced along the length of housing 16** for receiving therebetween a mating connector (not shown) in the direction of arrow "B".

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an insulation displacement type electrical connector for termination to a cable having a plurality of spaced apart conductors with insulation surrounding each conductor, said connector including:

an insulative housing having a termination face at which said connector is terminated to said cable, a mating face and a plurality of terminal receiving cavities for insertion thereinto of a plurality of terminals in a given insertion direction, each said cavity having a terminal securing region in which a terminal is retained in said cavity;

an insulation displacement type terminal contained within each cavity, each terminal having a generally planar insulation displacement section at one end including an insulation displacement slot opening from a first edge of said insulation displacement section for piercing the insulation surrounding one of said conductors, a contact section at an opposite end for mating with a mating terminal, an intermediate terminal securing section between the ends of the terminal for securing said terminal in a respective one of said cavities within the housing, and a transition section between said terminal securing section and said insulation displacement section for displacing said terminal securing section from the plane of said insulation displacement section in a first direction generally parallel to the axes of said conductors of said cable;

wherein the improvement in said connector comprises:

a second edge of each said insulation displacement section opposite said first edge has a terminal alignment notch therein; and said housing has a plurality of rib means adjacent said termination face, each for interengagement with one of said terminal alignment notches in said insulation displacement sections;

whereby upon insertion of said terminals into said cavities, the terminal alignment notch of each terminal engages a respective rib means to accurately align in a direction generally perpendicular to the axes of said insulated conductors of said cable the insulation displacement section of the terminal prior to termination thereof to one of said conductors.

2. The insulation displacement type electrical connector as set forth in claim 1, wherein the terminal alignment notch of each terminal is located to one side of the intersection between the insulation displacement section and its transition section.

3. The insulation displacement type electrical connector as set forth in claim 1, wherein each terminal is fabricated of stamped and formed sheet metal material and with a respective one of said ribs extending into the terminal alignment notch generally perpendicular to the plane of the insulation displacement section.

4. The insulation displacement type electrical connector as set forth in claim 3 wherein the terminal alignment notch of each terminal is located to one side of its transition section in a direction generally perpendicular to the axes of the insulated conductors of the cable.

5. In an insulation displacement type electrical connector for termination a plurality of insulated conductors, including a dielectric housing having a plurality of terminal-receiving passageways for insertion thereinto a plurality of terminals in a given insertion direction, each terminal including an insulation displacement end having an elongated insulation displacement slot for piercing the insulation about one of the conductors positioned along a predetermined axis, a terminal securing section spaced from said end for securing the terminal within one of said passageways, and a transition section between said insulation displacement end and said terminal securing section for displacing said terminal securing section from the plane of said insulation displacement end, wherein the improvement comprises:

each said terminal including an alignment portion of said insulation displacement end, said alignment portion having a given width in a direction perpendicular to both the axes of said conductors and the longitudinal axis of said insulation displacement slot; and complementary interengaging alignment means between the alignment portion of the insulation displacement end of said terminals and the housing and located within the bounds of said given width of the alignment portion in order to accurately position the insulation displacement end of the terminal along said predetermined axis, said complementary interengaging alignment means including a recess in one of said alignment portion and said housing and the other of said alignment portion and said housing having a projection for engaging said recess.

6. The insulation displacement type electrical connector as set forth in claim 5, wherein said terminals are fabricated of stamped and formed sheet metal material and said alignment portion thereof is generally planar with side edges, and said complementary interengaging alignment means is located between the side edges of the alignment portion.

7. The insulation displacement type electrical connector as set forth in claim 5, wherein said complementary interengaging alignment means includes a terminal alignment notch in said alignment portion opening towards said insertion direction and a rib on the housing for interengagement within the notch.

8. In an electrical connector for terminating a plurality of conductors, including a housing having a plurality of terminal receiving passageways for insertion thereinto of a plurality of terminals in an insertion direction, wherein the improvement comprises at least one of the terminals including an alignment portion of a given width, and wherein said at least one terminal is fabricated of stamped and formed sheet metal material and said alignment portion there of generally planar with side edges, and including complementary interengaging alignment means between the alignment portion and the housing and located between the side edges of the alignment portion, said complementary interengaging alignment means including a terminal alignment recess in said alignment portion opening towards said insertion direction and a projection on the housing for interengagement within the notch.

* * * * *